US005181946A

United States Patent [19]

Bosses et al.

[11] Patent Number: 5,181,946

[45] Date of Patent: Jan. 26, 1993

[54] CRIMPED VACUUM BAG SEAL AND METHOD OF MAKING THE SAME

[75] Inventors: Mark D. Bosses, New York; Yuri Milstein, Flushing, both of N.Y.

[73] Assignee: Home Care Industries, Inc., Clifton, N.J.

[21] Appl. No.: 832,578

[22] Filed: Feb. 7, 1992

[51] Int. Cl.[5] ..... B01D 46/02

[52] U.S. Cl. ..... 55/381; 55/382; 55/524; 55/DIG. 2; 156/581

[58] Field of Search ..... 55/368, 369, 374, 376, 55/381, 382, 524, DIG. 2; 156/515, 518, 530, 581

[56] References Cited

U.S. PATENT DOCUMENTS

| | | | |
|---|---|---|---|
| 2,610,137 | 9/1952 | Williamson et al. | 156/581 X |
| 2,813,596 | 11/1957 | Voigtman et al. | 183/69 |
| 3,369,348 | 2/1968 | Davis | 55/524 X |
| 3,479,802 | 11/1969 | Fesco | 55/DIG. 2 X |
| 3,498,031 | 3/1970 | Fesco | 55/368 |
| 3,535,855 | 10/1970 | Howard et al. | 55/368 |
| 3,859,064 | 1/1975 | Cordell | 55/368 |
| 4,116,648 | 9/1978 | Busch | 55/276 |
| 4,164,400 | 8/1979 | Wald | 55/382 |
| 4,374,888 | 2/1983 | Bornslaeger | 428/198 |
| 4,802,900 | 2/1985 | Ball et al. | 55/381 |
| 4,859,894 | 5/1986 | Gin et al. | 55/274 |
| 4,949,946 | 8/1990 | Lakey | 156/515 X |
| 5,047,075 | 9/1991 | Lin | 55/382 |
| 5,080,702 | 1/1992 | Bosses | 55/382 |

*Primary Examiner*—Charles Hart

*Attorney, Agent, or Firm*—Amster, Rothstein & Ebenstein

[57] ABSTRACT

A vacuum cleaner filter bag seal is used to form disposable vacuum cleaner bags by joining two portions of filtration material. The two portions of filtration material are sealed by placing them together and then crimping them so that the layers mechanically interlock. The invention also pertains to a method of providing such a seal.

12 Claims, 2 Drawing Sheets

CRIMPED VACUUM BAG SEAL AND METHOD OF MAKING THE SAME

BACKGROUND OF THE INVENTION

1. Field of the Invention

This invention relates to a vacuum cleaner filter bag seal which is used to form disposable vacuum cleaner bags by folding one or two pieces of filter material so that two sheets of the material lie parallel and adjacent to one another. The two pieces of material are joined to one another along their edges by crimping so that these edges mechanically interlock. The crimped region is then folded over for greater strength. The invention also extends to a method of providing such a seal.

2. Description of the Related Art

It is known to form vacuum cleaner bags by either folding one or overlapping two suitably-shaped pieces of filtration material and then sealing their edges to form an airtight bag. These constructions generally required the edges of the filtration material to be joined together to prevent the escape of gas and dust.

The most common method of vacuum bag construction involves placing the two pieces which are to be joined together and then folding both of the pieces in the same direction at least once. This technique is clearly shown in U.S. Pat. No. 3,498,031, which recognizes that such a folded seal can then be stapled, glued or sewn to better maintain its shape. This sort of folded seal is also shown in U.S. Pat. No. 4,116,648.

The use of folded seams is also set forth in U.S. Pat. No. 3,859,064, which shows a bag construction having several folded edges. Before the blank is folded to form the vacuum cleaner bag, adhesive is placed on the portions of the blank which are part of the folded seal.

Several different ways of joining fabric regions together to form a vacuum bag are discussed in U.S. Pat. No. 4,164,400. This patent suggests that such seals can be formed by sewing the pieces together and then folding them over. Alternatively, this patent suggests cementing or heat-sealing the two layers together. Techniques such as heat-sealing, high-frequency sealing or induction sealing are also mentioned.

U.S. Pat. No. 4,374,888 describes a non-woven laminated material suitable for use as a recreational fabric (rather than a vacuum cleaner bag material). The layers of the laminate are bonded together in a pattern so that the laminate has the look and feel of a woven fabric. The patent teaches that bonding can be carried out using either a patterned nip or ultrasonic bonding.

Finally, U.S. Pat. No. 2,813,596 describes a filter bag structure made from one to ten plies of wadding. This patent describes the use of folded-over end portions, and it also explains that the plies of wadding which make up the bag are held together by lines of embossing formed on those plies. The patent also recognizes that the embossing can be supplemented or even replaced by adhesive, or even sewing.

SUMMARY OF THE INVENTION

The present invention features a disposable vacuum cleaner bag which has superior filtering characteristics, and a method of making the same.

It is important to keep the construction and manufacture of disposable vacuum bags as simple as possible so that costs can be minimized. Since disposable vacuum cleaner bags must be changed regularly, they should not be so expensive that consumers find it more economical to replace them with reusable bags. Therefore, it is desirable to keep the construction of these bags simple, and to avoid using costly materials or complicated production techniques.

Accordingly, there is always interest in techniques or materials which markedly improve bag performance but which do not increase costs significantly.

Disposable vacuum cleaner bags are typically made either by folding a suitably shaped blank or by joining together two appropriately shaped blanks. In either case, the blanks are made from a suitable filtration material. Two different types of material may be used. Single ply material, which is the least expensive, is usually paper having suitable filtration characteristics. More recently, two-ply filtration material has been developed, and this material has markedly superior filtration properties. Such a two-ply material is described in U.S. Pat. No. 5,080,702, naming as an inventor one of the inventors of the present application, and commonly assigned. This double-ply material is made from a layer of paper having suitable filtration characteristics and a second layer of filtration material, preferably meltblown polymeric material. This additional layer of material is an additional filtration medium, and the two-ply material does a better job of filtering than the one-ply material.

Regardless of whether the disposable vacuum cleaner bag is formed from either a single folded piece or two separate pieces of filtration material, it will be necessary to join the edges of these pieces so that the bag is sealed, allowing dust to be trapped inside. Ideally, these edges can be joined to form a hermetic seal preventing any dust or gas from escaping.

Before two-ply vacuum bag material was used, enough dust escaped through the one-ply vacuum bag material itself so that any dust leakage through the folded-over end seals was relatively insignificant, and therefore was tolerated. However, with the use of the more efficient two-ply materials, dust escaping through the folded over end seals has become much more significant. Although adhesive could be used to help join the pieces of two-ply material together, this adhesive, owing to its thick consistency, does not readily penetrate and seal the pores in the meltblown layer of the two-ply material. Nor does heating the material to thin the adhesive help, because the meltblown material cannot withstand such elevated temperatures.

The sheet material used to form the vacuum cleaner bags sealed in accordance with the instant invention is typically what is referred to as either one-ply or two-ply material. The one-ply material is simply a sheet of paper having filtration characteristics which make it suitable for use as a vacuum cleaner bag. The two-ply material may have, in addition to a layer of paper like that used in the one-ply material, a layer of meltblown polymeric material disposed on the paper layer. The meltblown material contains many intertwined filaments and this structure is responsible for its ability to serve as a filtration medium. The polymeric material has a fairly low melting point, and when it is heated to a temperature near that melting point its structure breaks down.

While the following discussion of our invention refers only to one- and two-ply fabrics, those of ordinary skill in the art will readily appreciate that our invention can also be used with filtration materials having additional plies. Such materials might typically have a layer of meltblown material sandwiched between two layers of spunbonded material, and this laminate might even be bonded to a textile material to improve its abrasion resistance and other properties.

It is therefore an object of the present invention to provide a better seal for a vacuum cleaner bag, and a method for making the same.

It is a further object of this invention to provide a disposable vacuum cleaner bag which traps significantly more dust than conventional bags.

It is still another object of the present invention to provide a method for sealing vacuum cleaner bags made with meltblown material without damaging that material.

There has thus been outlined rather broadly the more important features of the invention in order that the following detailed description may be better understood, and in order that the present contribution to the art may be better appreciated. There are, of course additional features of the invention that will be described hereinafter and which will form the subject of the claims appended hereto. Those skilled in the art, however, will appreciate that the core concept which is described and amplified in this disclosure may readily be utilized or incorporated in structures other than those of the specific embodiments described herein. Accordingly, the following embodiments should be viewed as being merely illustrative of the broader invention. It is important, therefore, to recognize that the claims are not to be understood as being limited by the particular embodiments described herein, but rather that they be regarded as including such equivalent constructions and methods as do not depart from the spirit and scope of the broad invention.

BRIEF DESCRIPTION OF THE DRAWINGS

Specific embodiments of the invention have been chosen for purposes of illustration and description, and are shown in the accompanying drawings, forming a part of the specification wherein.

DESCRIPTION OF THE PREFERRED EMBODIMENTS

Referring to FIG. 2, a disposable vacuum cleaner bag 1 according to the instant invention may be fabricated from sheet material.

This sheet material may be one-ply or two-ply material. In fact, our invention can even be practiced with materials having more than two plies. It will only be necessary, however, to explain our invention insofar as it employs either one-ply or two-ply material, because when using a material having additional plies the invention is similar to that having two plies.

Figure 2A:
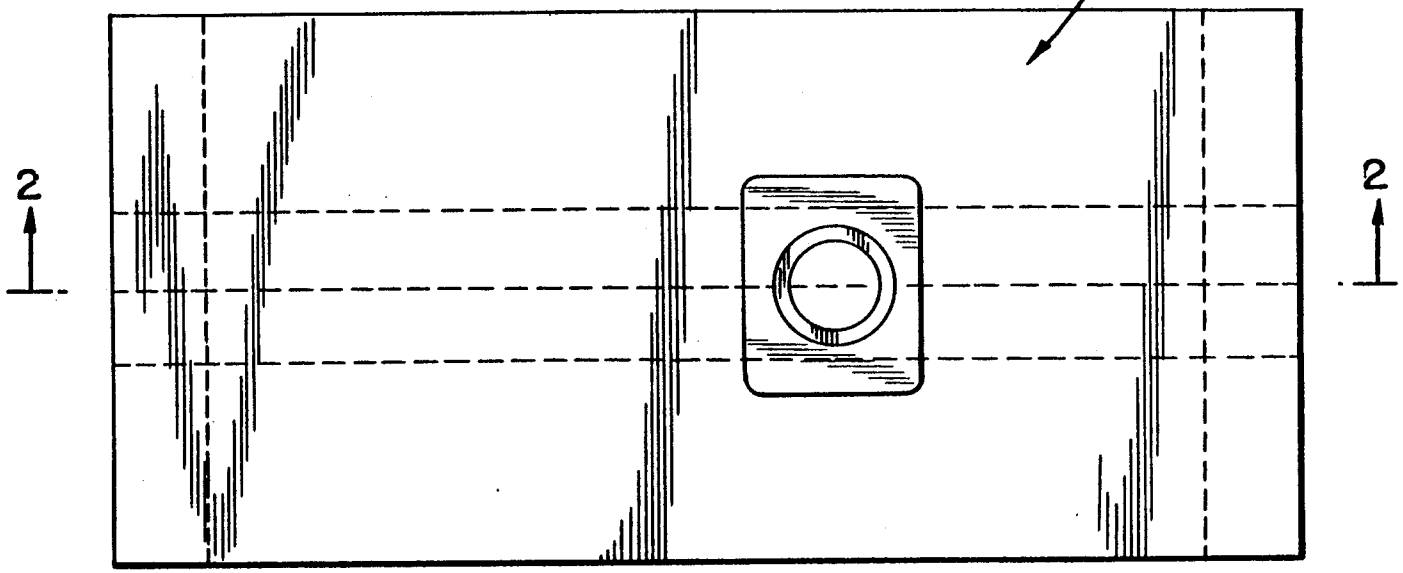
FIG. 2(A) is a top elevational view of a vacuum cleaner bag according to the claimed invention.
Figure 2B:
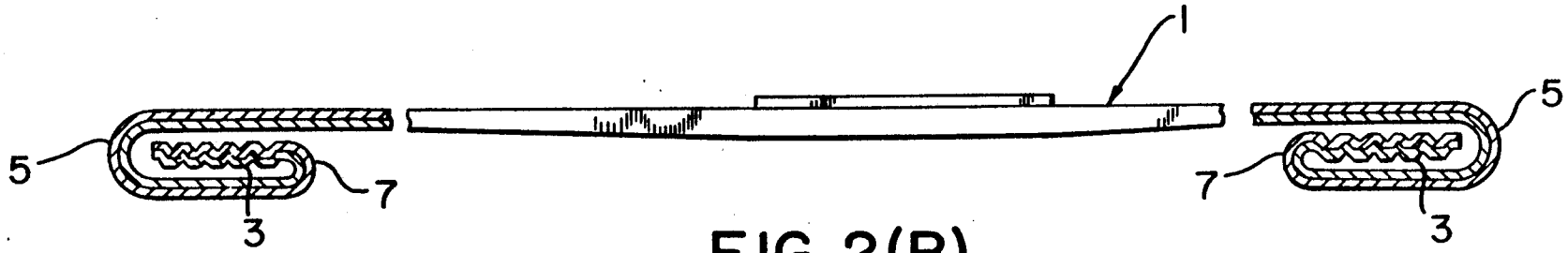
FIG. 2(B) is a side sectional view as seen along line 2-2' in FIG. 2(A) showing a cross section of a vacuum bag according to the claimed invention.

Disposable vacuum cleaner bags, depending upon whether they are formed from one or two pieces of material, have one or two ends at which two pieces of vacuum cleaner bag material are joined. FIGS. 2(A) and 2(B) show a vacuum cleaner bag of the latter type.

The one-ply material is typically paper of a weight and porosity suitable for use as a vacuum cleaner bag. Other materials, of course, can be used in lieu of paper. The two-ply material is made from a first ply, again typically paper, and a second ply of filtration material, preferably meltblown polymeric material, laid atop the first ply.

The meltblown layers can be formed from a variety of materials, preferably, synthetic thermoplastics, including, for example, polypropylene, polyethylene terephthalene, polyethylene, polyamides, polyester, nylon, and other polymers known in the art. The preferred thermoplastic material for forming the layer is polypropylene.

As pointed out previously, it is well-known to seal these ends by folding the material one or more times. It is also known to use adhesive between the ends or outside the ends, tape or stitching to maintain the seal. Unfortunately, these techniques all increase the cost of the vacuum bag, since they each require additional material such as adhesive, tape or thread. In addition, it is essential that the folded end seals prevent dust leakage. As filter materials have been developed which do a better job of capturing fine particles, it has correspondingly become more important to prevent these particles from passing through those seals.

Figure 1:
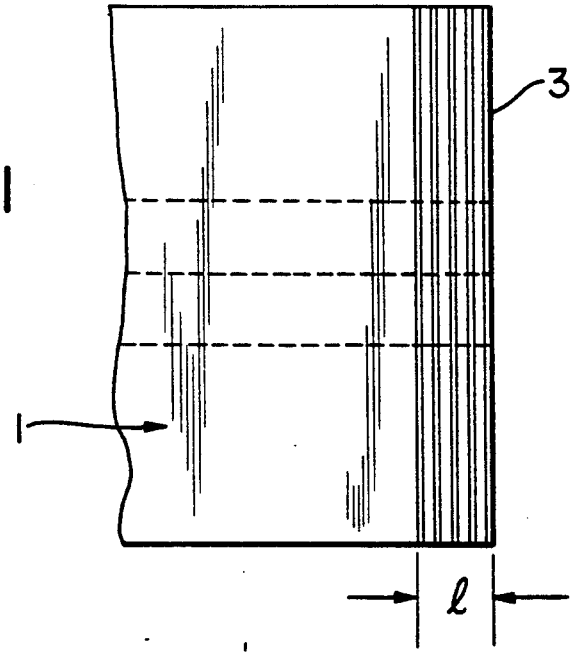
FIG. 1 is a top elevational view, prior to final assembly, of an end portion of a vacuum cleaner bag sealed in accordance with the claimed invention.

The following description of our invention can best be understood with reference to FIGS. 1, 2(A) and 2(B).

FIG. 1 shows two overlapping pieces of filter material, the ends of which have been crimped together in a crimped zone 3. Here crimped zone 3 runs across the width of the two pieces of material. The length "l" of the crimped zone necessary to produce a satisfactory seal can be determined through routine experimentation. Likewise, the amount of deformation in the direction perpendicular to the plane of the filter material can also be determined through experimentation.

FIGS. 2(A) and 2(B) show a finished vacuum cleaner bag according to our invention. The crimped regions 3 are no longer exposed, having been hidden by being twice folded under the filter material in traditional fashion. The folds 5, 7 themselves now serve to strengthen the vacuum cleaner bag against forces tending to separate the two sealed pieces of material. This is very important, because while a crimped seal may be able to withstand a good deal of shear stress, it cannot withstand much stress in a direction normal to the plane of the crimped region. In vacuum cleaner bags not constructed according to our invention these folded portions are relied upon to provide strength, prevent separation, and seal to prevent the escape of trapped dust. Such folds must tightly compress the pieces of material so that there are no gaps through which dust can escape, and that requires the use of enough adhesive or tape to keep the folds from opening. In our invention, the seal is provided by the crimped region 3, not the folds 5, 7, and so the folds themselves can be held together less securely. While it was also known to spread adhesive between the region later folded, this adhesive helping to seal the bag, those of ordinary skill in the art will appreciate that this cannot be done for vacuum bags constructed using two-ply material, since the adhesive would be unable to penetrate into the second ply of filtration material.

Those of ordinary skill in the art will appreciate that numerous refinements of our invention are possible. For example, before placing the two filter materials together, one can spread adhesive between the two filter materials in the region which is later crimped.

Figure 3:
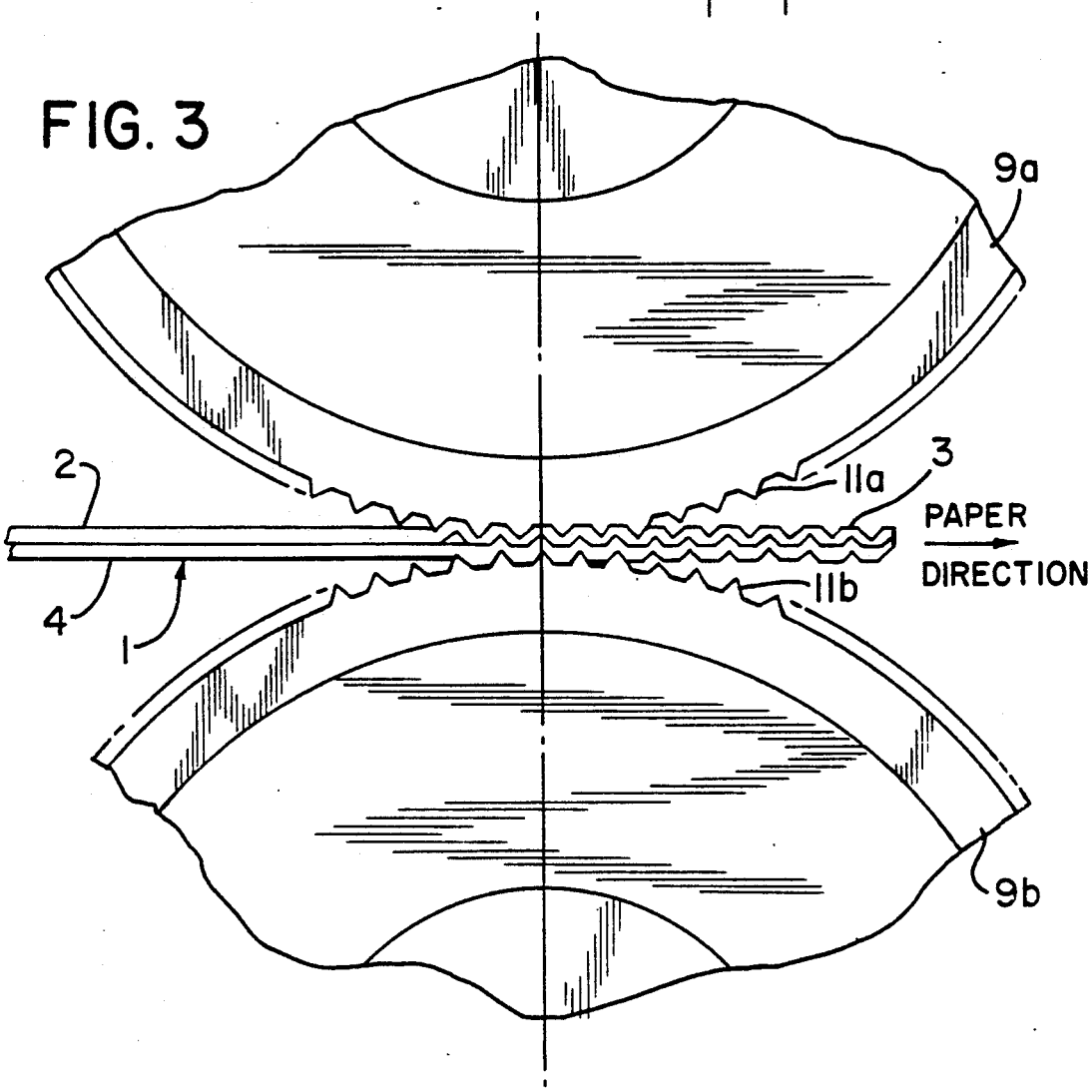
FIG. 3 is a side elevational view of an apparatus in accordance with the claimed invention.

The portions of the two pieces of filter materials being joined can be crimped together in many ways. One way, shown in FIG. 3, is to juxtapose the two pieces of material 2, 4 to be joined and pass them through the nip of two compression rollers 9*a*, 9*b*. Each of these rollers has a knurled surface 11*a*, 11*b*, and the knurl patterns on the two rollers match. The knurled surfaces operate in registry such that elevated regions of one roller engage depressed regions of the other roller, and vice versa. Accordingly, any material passing through the nip will be crimped according to the pattern of the roller surfaces. Nip size and roller compressive force can be selected in accordance with well-known crimping techniques.

The length "l" of the crimped region can be precisely controlled by limiting the angular displacement of the knurled rollers while the two pieces of material pass between.

Our invention is not limited to the use of matching knurled rollers, but rather, will work with all crimping techniques. For examples, one could replace the knurled rollers with suitably-patterned stamping dies.

In a further embodiment of our invention, the crimped zones 3 are at least partially dipped into a liquid adhesive so that when the adhesive cures, an additional seal is formed on the exposed ends of the bag material.

Again, the aforementioned embodiment of our invention will work with both one-ply and two-ply materials. In fact, this invention is particularly well-suited to sealing two-ply materials.

This two-ply material can be processed in the same manner as the one-ply material. We have discovered, however, that particularly good seals can be achieved by heating the knurled rollers 9*a*, 9*b* (or stamping dies) so that the meltblown material softens but does not melt or otherwise become damaged.

While the present invention has been described with respect to what is presently considered to be the preferred embodiment, it is to be understood that the invention is not limited to the specifics of the embodiment described herein. The present invention is intended to cover various and equivalent arrangements included within the spirit and scope of the appended claims.

What is claimed is:

1. A crimped vacuum cleaner bag seal comprising:

a first sheet portion of filtration material;

a second sheet portion of filtration material, said first and said second portions being juxtaposed against one another;

at least one of said first sheet portion and said second sheet portion having at least two layers, said layers comprising at least one layer of meltblown polymeric material and at least one layer of non-meltblown material; and a crimped region provided on said first and second sheet portions so that said first and second sheet portions are interlocked to a degree which substantially prevents passage of at least one of gas and dust through said seal.

2. A crimped vacuum cleaner bag seal according to claim 1, wherein said crimped region is folded over so that said crimped region is at least partially concealed.

3. A crimped vacuum cleaner bag seal according to claim 2, wherein said crimped region which has been folded is kept folded by a layer of an adhesive.

4. A crimped vacuum cleaner seal bag according to claim 1 wherein said first sheet portion and said second sheet portion are regions on a blank of filter material.

5. A crimped vacuum cleaner bag according to claim 1 wherein said first sheet portion is a region on a first blank and said second sheet portion is a region on a second blank.

6. A crimped vacuum cleaner bag seal according to claim 1, wherein said first sheet portion has a first edge, said second sheet portion has a second edge, said first edge and said second edges being adjacent to one another, and further comprising a region of an adhesive deposited over said first and said second edges.

7. A method for forming a crimped seal on a vacuum cleaner bag comprising:

providing a first sheet portion of filtration material and a second sheet portion of filtration material wherein at least one of said first sheet portion and said second sheet portion have at least two layers, said layers comprising at least one layer of meltblown polymeric material and at least one layer of non-meltblown material;

juxtaposing said first sheet portion and said second sheet portion together; and crimping at least part of said first sheet portion and at least part of said second sheet portion together to form a crimped region.

8. A method according to claim 7, further comprising the step of folding said crimped region over so that said crimped region is at least partially concealed.

9. A method according to claim 8, further comprising the step of applying a layer of an adhesive near said crimped region before said folding step so that said crimped region is kept folded by said layer of adhesive.

10. A method according to claim 7 wherein said first sheet portion and said second sheet portion regions are on a blank of filter material.

11. A method according to claim 7 wherein said first sheet portion is a region on a first blank and said second sheet portion is a region on a second blank.

12. A method according to claim 7, wherein said first sheet portion has a first edge and said second sheet portion has a second edge, and first and said second edges being adjacent to one another, and further comprising the step of applying a region of an adhesive over said first and said second edges.

* * * * *